US011183344B2

(12) United States Patent
Andersson et al.

(10) Patent No.: US 11,183,344 B2
(45) Date of Patent: Nov. 23, 2021

(54) GRAPHENE COMPOSITE MATERIAL FOR SLIDING CONTACT

(71) Applicant: Hitachi Energy Switzerland AG, Baden (CH)

(72) Inventors: Anna Andersson, Västerås (SE); Mamoun Taher, Västerås (SE); Ulf Jansson, Uppsala (SE); Martin Wåhlander, Farsta (SE); Leili Tahershamsi, Uppsala (SE); Helene Grennberg, Uppsala (SE)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 16/604,453

(22) PCT Filed: Apr. 10, 2018

(86) PCT No.: PCT/EP2018/059104
§ 371 (c)(1),
(2) Date: Oct. 10, 2019

(87) PCT Pub. No.: WO2018/189146
PCT Pub. Date: Oct. 18, 2018

(65) Prior Publication Data

US 2020/0152399 A1 May 14, 2020

(30) Foreign Application Priority Data

Apr. 12, 2017 (EP) ..... 17166142

(51) Int. Cl.
*H01H 1/0237* (2006.01)
*B22F 1/00* (2006.01)
(Continued)

(52) U.S. Cl.
CPC ..... *H01H 1/0237* (2013.01); *B22F 1/0018* (2013.01); *B22F 1/0022* (2013.01);
(Continued)

(58) Field of Classification Search
CPC .. B22F 1/0059; B22F 1/0018; B22F 2302/40; H01H 1/027; H01B 1/02; H01B 1/04; H01B 1/24
(Continued)

(56) References Cited

U.S. PATENT DOCUMENTS

2011/0256014 A1 10/2011 Hong et al.
2016/0016803 A1 1/2016 Stoltz et al.

FOREIGN PATENT DOCUMENTS

CN 102218540 A 10/2011
CN 102385938 A * 3/2012 ..... C22C 1/00
(Continued)

OTHER PUBLICATIONS

XGsciences (https://xgsciences.com/wp-content/uploads/2018/02/xGnP-datasheet_C-grade_033117.pdf—accesses Apr. 16, 2020) (Year: 2020).*

(Continued)

*Primary Examiner* — Tri V Nguyen
(74) *Attorney, Agent, or Firm* — Sage Patent Group

(57) ABSTRACT

A metal-graphene composite product in the form of a sliding contact of an electric power application, in which graphene flakes are dispersed in a matrix of the metal, as well as to a method for obtaining such a composite product.

8 Claims, 2 Drawing Sheets

(51) Int. Cl.

| | |
|---|---|
| ***B22F 3/16*** | (2006.01) |
| ***C22C 26/00*** | (2006.01) |
| ***H01H 1/027*** | (2006.01) |
| ***H01B 1/02*** | (2006.01) |

(52) U.S. Cl.
CPC ..... *B22F 1/0059* (2013.01); *B22F 3/16* (2013.01); *C22C 26/00* (2013.01); *H01H 1/027* (2013.01); *B22F 2302/40* (2013.01); *B22F 2998/10* (2013.01)

(58) Field of Classification Search
USPC ..... 252/500, 502, 506
See application file for complete search history.

(56) References Cited

FOREIGN PATENT DOCUMENTS

| | | | | | |
|---|---|---|---|---|---|
| CN | 103346022 | A | | 10/2013 | |
| CN | 105047421 | A | | 11/2015 | |
| CN | 105385877 | A | * | 3/2016 | ..... C22C 5/06 |
| CN | 105575684 | A | * | 5/2016 | ..... H01H 1/027 |
| CN | 105575684 | A | | 5/2016 | |
| CN | 105575684 | A1 | | 5/2016 | |
| CN | 105821234 | A | * | 8/2016 | ..... B22F 3/04 |
| CN | 106057272 | A | * | 10/2016 | ..... H01B 1/026 |
| CN | 106111973 | A | | 11/2016 | |
| JP | 2016000843 | A | * | 1/2016 | ..... B22F 1/00 |
| KR | 10-2011-0115085 | | | 10/2011 | |
| KR | 10-1568126 | | | 11/2015 | |
| KR | 10-2016-0040688 | | | 4/2016 | |
| KR | 20160053303 | A | | 5/2016 | |
| KR | 10-2016-0079115 | | | 7/2016 | |
| KR | 20160116113 | A | * | 10/2016 | ..... C01B 31/02 |
| RU | 2012139358 | A | | 3/2014 | |
| RU | 2536847 | C2 | | 12/2014 | |
| WO | WO 2010/139423 | A1 | | 12/2010 | |
| WO | WO 2011/101788 | A1 | | 8/2011 | |
| WO | WO 2015/019093 | A1 | | 2/2015 | |
| WO | WO 2015/075455 | A1 | | 5/2015 | |
| WO | 2016149150 | A1 | | 9/2016 | |

OTHER PUBLICATIONS

Uysal "Structural and sliding wear properties of Ag/Graphene/WC hybrid nanocomposites produced by electroless co-deposition." Journal of Alloys and Compounds 654 (2016) 185-195 (Year: 2016).*

F. Mao et al: "Graphene as a lubricant on Ag for electrical contact applications" J. Mater Sci (2015) 50:6518-6525, Published Online Jul. 3, 2015 8 Pages.

Yee Maxine Swee-Li; et al: "Green synthesis of graphene-silver nanocomposites and its application as a potent marine antifouling agent", Colloids and Surfaces. B, Biointerfaces, Elsevier, Amsterdam, NL, vol. 148, Sep. 9, 2016 pp. 393-394.

International Search Report and Written Opinion of the International Searching Authority Application No. PCT/EP2018/059104 Completed: May 23, 2018; dated Jun. 6, 2018 12 Pages.

M. Tabandeh-Khorshid et al.: "Tribological performance of self-lubricating aluminum matrix nanocomposites: Role of graphene nanoplatelets", Engineering Science and Technology, An International Journal 19 (2016) pp. 463-469.

Search Report, Russian Patent Application No. 2019134766 (PCT/EP2018/059104), dated Feb. 17, 2020, 10 pages.

Notice of Grounds for Rejection, Korean Patent Application No. 10-2019-7029541 (PCT/EP2018/059104) dated Apr. 8, 2020, 4 pages.

Office Action dated May 13, 2020 for Chinese Patent Application No. 201880024437.5, 7 pages.

* cited by examiner

GRAPHENE COMPOSITE MATERIAL FOR SLIDING CONTACT

TECHNICAL FIELD

The present disclosure relates to a metallic composite material for a sliding contact of an electrical power switch.

BACKGROUND

Silver (Ag)-based contact materials are commonly used in various electrical power switching devices, where low losses and stable contact performance over life are of key importance. Ag is used as base material in both arcing and sliding contact systems, owing to its electrical properties. However, the mechanical and tribological properties of Ag are not impressive. It is soft and prone to cladding onto counter surfaces. For sliding contacts this usually means high wear rate and high friction.

When Ag is used in sliding contact configurations vs a copper (Cu) or Ag counter surface, a substantial amount of silver must be added to the contact to account for wear losses. The cladding of Ag onto a counter surface creates, in essence, an Ag—Ag contact. The coefficient of friction (COF) of such a contact in a lubricant-free environment is as high as 1.5 or higher. In a mechanical system this friction needs to be overcome by the mechanical drive system of the device, which, in tum, costs drive energy and size in terms of the mechanical system dimensioning.

Nevertheless, Ag is still used in many applications, e.g. in on-load tap changers (OL TC's) and various breakers, owing to its electrical properties.

One common method to decrease friction in Ag-based contacts is to apply a lubricating contact grease. However, with high switching demands, such as several hundreds of thousands or even millions of operations during the device lifetime, a grease is not a sustainable solution without regular additions of more grease. In addition, thermal load on the device may lead to grease evaporation or decomposition, which can cause increased resistance and unstable contact properties. In applications like OL TC's, where switching components are submerged in electrically insulating transformer oil, application of a liquid lubricant oil or grease is not even possible.

Adding graphite (at a concentration of a few percent by weight, wt %) to metallic silver gives a reduction of the COF down to ca. 0.3 vs. Ag or Cu counter surface. The hardness and density of such a composite is however limited owing to a low adhesion of the carbon surface to the Ag-matrix. This gives a high wear rate and substantial particle generation for Ag-graphite components.

So called 'hard silver' (e.g. Argalux®64), an Ag alloy containing Ag, Cu and a small amount of antimony (Sb) is used in some commercial applications. Sb increases hardness significantly for this alloy, conductivity is fairly good, but COF is still in the region of 0.3-0.4 vs. Cu.

Graphene (G) and graphene oxide (GO) is known to have lubricating effects as a top coat in metal-to-metal contacts [F. Mao et al., J. Mater. Sci., 2015, 50, 6518; and D. Berman et al., Materials Today, 2014, 17(1),31]. There are also studies of graphene having a lubricating effect in structural composites of aluminum (Al) [M. Tabandeh-Khorshid et al., J. Engineering Sci. and Techn., 2016, 19, 463]. Friction coefficients down to circa 0.2 in dry metal-to-metal contacts have been reported in literature.

There are some general challenges using graphene and related materials for such applications. The quality and purity of materials obtained from suppliers differ a lot and especially graphene oxide, which is almost always produced by the well-established Hummer's method, usually contain calcium (Ca) and magnesium (Mg) residues and is supplied in a broad range of flake sizes. Another well-known fact is that G and especially GO tend to agglomerate and are difficult to disperse in metal matrices. In addition, pure graphene is still very expensive, which makes graphene oxide more attractive from an industrial point-of-view.

SUMMARY

It is an objective of the present invention to provide a metal-graphene composite material with improved tribological properties for a sliding contact of an electrical power switch.

The invention relates to a metal-graphene composite material with unusually good properties, especially as sliding contact material.

The graphene is typically in the form of flakes, having a thickness from a single graphene layer (Angstrom range thickness) to graphene nano-sheets (NS) having a nano-range thickness.

The use of graphene oxide GO, rather than non-oxidized graphene G, as a low-cost graphene starting material for some embodiments of the new composite contact material reduces the cost. However, in other embodiments, any type of graphene, e.g. G or any mixture of GO and G, may be used. The term "graphene" is intended to cover both G and any graphene oxide, GO, as well as any mixture thereof.

A new cleaning method of GO that provides clean, metal- and ion-free GO flakes with uniform size distribution (small particles removed), may be used to obtain good dispersion of the GO flakes in the metal matrix. Improved dispersing of GO in the metal matrix reduces the amount of GO needed and hence limits the effect of the GO on the electrical properties.

Careful sintering of a green body of the composite, which allows gaseous species to be released from the GO flakes and escape the composite, may lead to reduction of at least some of the GO to G (also denoted rGO herein).

During sliding in a sliding contact, there is a continuous supply and removal of G, GO and/or rGO to the contact pair surfaces, providing lubrication effect, while the GO/G amount is still small enough to maintain the beneficial electrical properties of the metal, e.g. Ag.

According to an aspect of the present invention, there is provided a metal-graphene composite product in the form of a sliding contact of an electric power application, in which graphene flakes are dispersed in a matrix of the metal.

According to another aspect of the present invention, there is provided a method of producing a metal-graphene composite product. The method comprises suspending graphene flakes in a solvent to obtain a graphene-solvent suspension. The method also comprises suspending metal nanoparticles in a solvent to obtain a metal-solvent suspension. The method also comprises mixing the metal-solvent suspension and the graphene-solvent suspension with each other, forming a mixture. The method also comprises evaporating the solvent from the mixture to obtain a metal-graphene powder having a graphene content of less than 0.5 wt %. The solvent used may be the same in the graphene-solvent suspension and the metal-solvent suspension, e.g. ethanol. The obtained metal-graphene powder may be further dried under elevated temperature, e.g. above 80° C.

such as about 100° C. The obtained metal-graphene powder may be compacted to a green body, which may then be sintered.

The new composite contact material has the benefit of providing very low friction and low wear rate compared with pure Ag or Cu, without sacrificing the good electrical properties of the pure metal. The composite material has a small amount (down to 0.01 or even 0.005 wt %) of G or GO, or a mixture thereof, dispersed in a metal matrix. The metal matrix may be any of e.g. silver (Ag), cupper (Cu), Aluminum (Al), gold (Au), platinum (Pt), indium (In) or tin (Sn), or a combination thereof, preferably Ag. This provides a composite material with a substantially lower friction and higher wear resistance in dry conditions compared to pure Ag, commercially available Ag-graphite or hard Ag composite, and even to oil- or grease lubricated Ag.

It is to be noted that any feature of any of the aspects may be applied to any other aspect, wherever appropriate. Likewise, any advantage of any of the aspects may apply to any of the other aspects. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc.," are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

Embodiments will be described, by way of example, with reference to the accompanying drawings, in which.

DETAILED DESCRIPTION

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

Although silver is preferred and used as an example of the base metal of the metal-graphene composite material discussed herein, any other suitable electrically conducting metal, or combination thereof, such as Al or Cu, may be used instead.

When graphene flakes, e.g. NS, are discussed herein, it is understood that at least some of the graphene in the flakes are in the form of GO, unless otherwise specified. Graphene flakes as well as rGO typically comprise a mixture of G and GO.

By using the metal-graphene composite material in at least one of the contact pairs of a sliding contact of an electric power application, e.g. in an OLTC, the friction can be reduced compared with using pure metal contact pairs, thus improving the wear resistance of the sliding contact and prolong its operational life, while still retaining the good electrically conducting properties of the pure metal since the amount of graphene dispersed in the metal matrix can be kept low thanks to embodiments of the method of producing the metal-graphene composite of the present disclosure.

Figure 1:
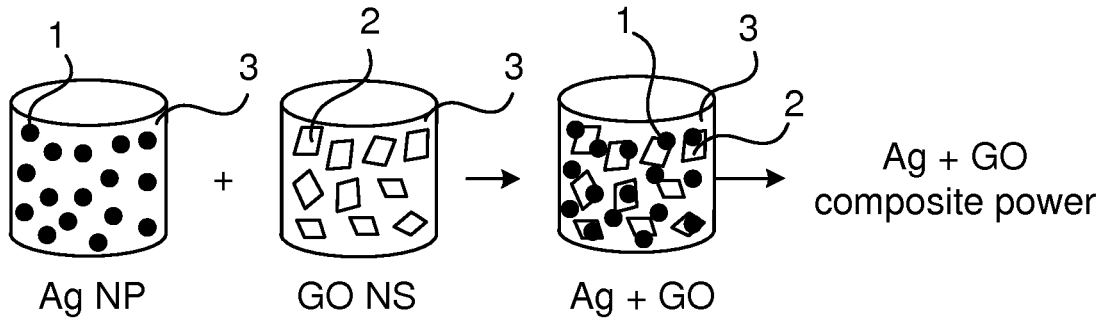
FIG. 1 illustrates an embodiment of mixing suspended Ag nanoparticles (NP) with suspended GO flakes to obtain an embodiment of the composite powder.

FIG. 1 illustrates embodiments of a method of producing the metal-graphene composite powder. In these embodiments, the metal is silver and Ag nanoparticles (NP) 1 are suspended in a solvent 3 to form a metal suspension. The solvent may be any suitable solvent, e.g. water or ethanol, or a mixture thereof, which are polar and environmentally friendly solvent options. In parallel, the graphene (G and/or GO) flakes, e.g. NS, 2 are also suspended in a solvent 3, e.g. the same or similar solvent as in the metal suspension, to form a graphene suspension. The graphene flakes preferably have an average longest axis as measured within the range of from 100 nm to 50 μm, 30 μm, 10 μm 1 μm or 500 nm, e.g. within a range of from 1 or 10 to 20 μm, and an average thickness of at most ten graphene layers. The graphene suspension may be sonicated to prevent agglomeration of the graphene flakes in the suspension.

The metal suspension and the graphene suspension are mixed, e.g. by adding the graphene-solvent suspension to the metal-solvent suspension, to form a mixture. In some embodiments, the metal-graphene composite suspension mixture is sonicated to further improve the mixing and dispersion of the graphene flakes 2 with the metal NP 1 and to prevent agglomeration of the graphene flakes in the suspension. There is preferably no chemical reaction taking place between the metal NP and graphene during the mixing. The mixing is for obtaining good dispersion of the graphene flakes. The graphene flakes are preferably present in an amount of less than 0.5, 0.2 or 0.05 wt % of the combination of the graphene flakes and the metal NP in the suspension, such as within the range of from 0.005 wt % to 0.5, 0.4, 0.2, 0.1, 0.05 or 0.02 wt %, e.g. about 0.01 wt %. For instance, a suspension of 0.001 g GO (e.g. in 100 mL ethanol) may be mixed into a suspension of 10 g metal NP (e.g. in 500 mL ethanol). Drop mixing may be preferred in order to make sure that the graphene flakes are properly dispersed in the mixture, avoiding agglomeration. For instance, the graphene suspension may be drop mixed into the metal suspension during at least 20 or 30 minutes to obtain a composite suspension having a dry weight of about 10 g.

Then, the solvent is evaporated from the metal-graphene composite suspension to form a metal-graphene composite powder, e.g. an Ag-GO composite powder in this case. To reduce the energy needed for the evaporation, a relatively volatile solvent may be preferred, e.g. ethanol, which may be recycled to save cost and the environment. The evaporation of the solvent may be followed by drying of the metal-graphene composite powder at an elevated temperature of e.g. at least 80° C. such as at about 100° C. to remove traces of solvent and/or water.

In order to improve the quality of the graphene suspension and final composite product, with relatively pure graphene having a relatively uniform flake size distribution and low amount of agglomeration, the graphene flakes are preferably washed and centrifuged before mixing with the metal NP. In some embodiments, prior to obtaining the graphene suspension, the graphene flakes are subjected to a plurality of sequential wash cycles, wherein each of the wash cycles comprises suspension of the graphene flakes, centrifugation of the suspension and removal of the supernatant.

An objective of the wash process may be to purify graphene oxide (GO). The process reduces the amount of inorganic impurities, increases the pH of aqueous purified GO solutions towards neutral, and decrease the proportion of small, highly oxidized carbonaceous components. The new process may involve ultra-sonication and (ultra-)centrifugation-assisted sedimentation. The process is efficient, limits aggregation of the purified GO flakes and allows a change of solvent for the GO solution/suspension/paste from water to water-miscible organic solvents such as low-boiling alcohols, e.g. ethanol.

In example embodiments of the wash process, the suspension of GO in water (e.g. 3-4 mg impure GO/mL) may be mixed with the same volume of ethanol (e.g. 99% pure) with bath sonication for at least 10 minutes, after which the mixture is transferred to appropriate centrifugation flasks. Centrifugation at medium speed (5000-6000 g) for 4-8 hours sediments the GO, leaving the most soluble impurities in the supernatant. Removal of the supernatant, without disturbing the sediment material, leaves a concentrated water-ethanol suspension of GO of higher purity. Fresh ethanol is added, followed by sonication, centrifugation and supernatant removal, this sequence may be repeated 2-4 times with centrifugation speed increasing and centrifugation time decreasing for each wash cycle. When GO has reached sufficient purity and the water content is low enough, the supernatant is colorless and the sedimented GO, after removal of the supernatant, has a gel-like appearance and a GO concentration of 30-40 mg/mL. This concentrated GO gel may be dissolved/suspended in water and in water-miscible organic solvents.

An objective of the wash process is to separate GO into, preferably, monolayer sheets and disperse them as evenly possible in a metal matrix. The method includes a wet mixing process, suspending both metal nanoparticles (NP) 1 and cleaned GO flakes 2 as discussed in relation to FIG. 1, first separately in ethanol suspensions and then mixing together the two suspensions and evaporating the solvent 3 to get a well-dispersed e.g. Ag-GO mixture. This mixture may then be pressed and sintered into the final contact material.

The obtained metal-graphene composite powder may then be compacted to a green body e.g. at room temperature and a pressure of at least 400 MPa or 500 MPa, e.g. within the range of 400-600 MPa, which may be preferred for Ag NP 1. By compacting, the density of the metal-graphene composite product may come closer to a cast metal product, e.g. metallic silver, e.g. at least 70% or at least 80% or at least 85% of cast metal density.

The green body may be used for the sliding contact, or the green body may be sintered and the sintered product be used for the sliding contact.

Sintering, in which the metal particles are diffused together to form a more solid product, similar to a cast metal product, may (e.g. for silver) be performed at a temperature within the range of 300–500° C., e.g. at about 400° C., for a prolonged time period, e.g. at least 10 h or at least 15 h. By sintering, the density of the metal-graphene composite product may come close to a cast metal product, e.g. metallic silver, e.g. at least 90% or at least 95% of cast metal density. Sintering may also reduce some or all of the GO to G, i.e. rGO. However, the improved tribological properties may be achieved regardless of the relative proportions of G and GO in the metal-graphene composite.

EXAMPLES—GREEN BODY

Figure 2:
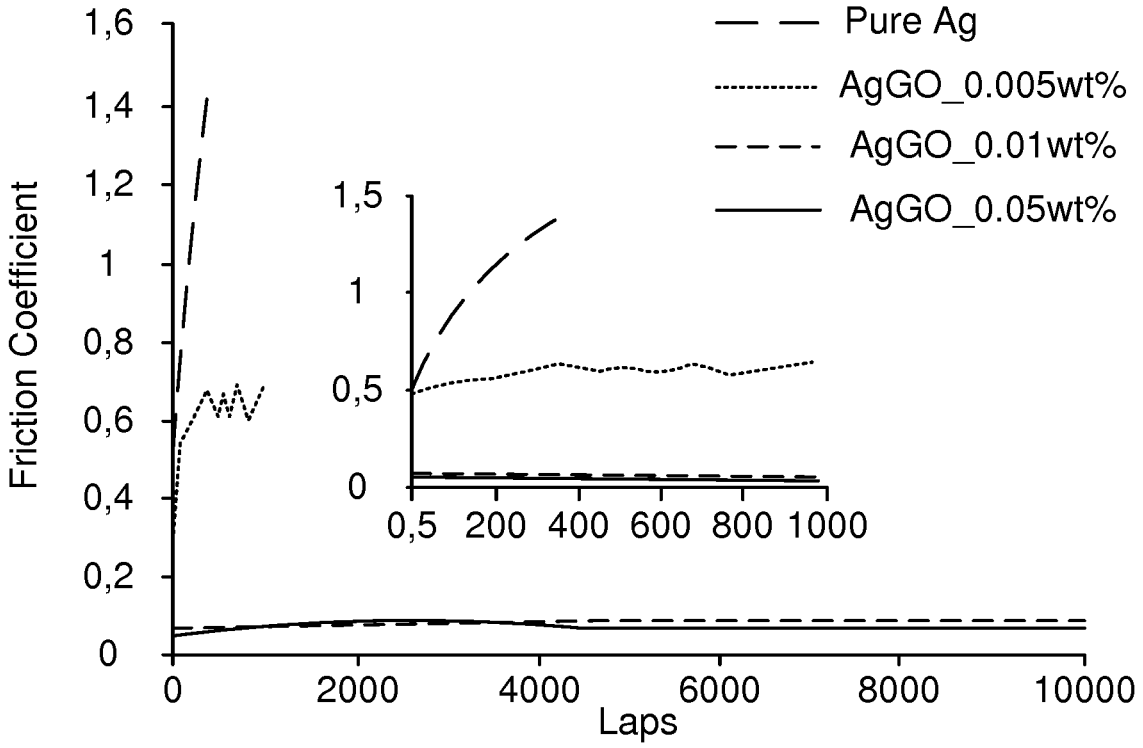
FIG. 2 is a graph showing the COF of different composites compared with a pure Ag reference sample.

With reference to FIG. 2, tribological pin-on-disc measurements were carried out on pure Ag and Ag-GO green-body composites (density ca. 85% of cast silver) at a constant contact load of 5 N and with a counter contact being an Ag-coated Cu pin. The pure Ag reference shows a rapidly increasing COF. At a point of $\mu \sim 1.4$, the settings of the tribometer stops the experiment due to force overload. When adding GO in different amounts to the Ag matrix of the disc sample, the friction drops significantly compared with the pure Ag reference sample. At a concentration of only 0.01 wt. %, the friction coefficient stabilizes around 0.09, and adding more GO does not significantly reduce the friction further (see sample with 0.05 wt % GO). These experiments were run at completely dry conditions, i.e. no extra lubricant oil or grease is added to the contacts. The only lubricant present is GO, and the effect is clear at concentrations as low as 0.01 wt %. To compare, a grease-lubricated Ag—Ag contact would have a friction coefficient of ca. 0.2 and an Ag—Ag or an Ag—Cu contact in transformer oil (cf. tap changer switches) would range between 0.3 and 1 depending on temperature.

The wear of an Ag—Ag contact is difficult to measure as the Ag is soft and tend to clad and re-clad back and forth between the two mating surfaces. Ploughing also occurs. An uneven wear track is formed, due to the cladding behavior. On the other hand, the Ag-GO (0.01 wt %) composite sample exposed to 10,000 operations showed a much smoother and less worn wear track. Comparing the wear rates of these two samples (wear volume normalized to the load and wear length), the Ag-GO sample has a significantly lower wear rate than pure Ag.

Contact resistance measurements carried out using an Ag-coated Cu probe, under different contact loads, showed very similar data for pure Ag compared to Ag-GO (0.01 wt %). This indicates a very minor contribution from the GO component in the composite material, which essentially behaves electrically like pure silver.

The green body composites with a GO content of 0.01 wt %, as analyzed by light-optical microscopy (LOM), revealed an even distribution of large graphene oxide sheets in the Ag matrix.

Scanning electron microscopy (SEM) showed thin, transparent GO sheets with dispersed Ag nanoparticles above and below the sheets. This suggests well-separated GO and Ag particles. The transparency of the GO sheets indicates that they contain mono-layers or few layers of GO stacked on top of each other.

When regular dry-powder mixing is used instead of the wet mixing process of the present disclosure, GO flakes have a strong tendency to stick together. Also, when contaminated GO is used, the composite will not be well-dispersed and the GO flakes agglomerate into GO lumps. A tribological effect is still obtained, but the friction coefficient stabilizes at circa 0.2-0.4, i.e. significantly higher than for the composite material of the present disclosure. The dry mixed composite also requires higher concentrations of GO, circa 0.5 wt %, to reach efficient lubrication.

Figure 3:
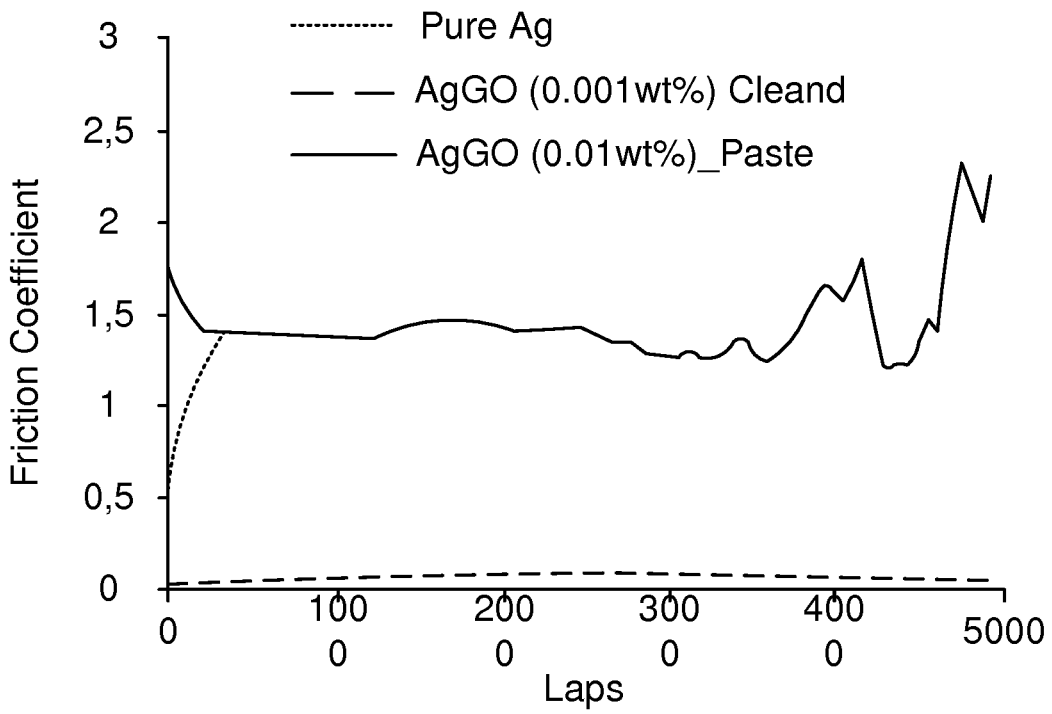
FIG. 3 is a graph showing the COF of different other composites compared with a pure Ag reference sample.

With reference to FIG. 3, to achieve the beneficial properties at very low graphene concentrations, the cleaning process may be important. In FIG. 3, the friction of green-body composites containing 0.01 wt % GO as received from a commercial supplier is compared with green-body composites containing 0.01 wt % GO washed in accordance with the wash process of the present disclosure. The improvement with cleaning is clear and is attributed to better dispersion of the cleaned, uniform GO.

Well-dispersed GO flakes in an Ag matrix enhances tribological properties and performance without sacrificing the electrical properties of pure Ag.

By the GO cleaning process, that efficiently removes metallic and ionic residues and narrows flake size distribution, as well as a wet mixing protocol, a well dispersed Ag-GO nanocomposite product may be obtained.

Very small amounts (e.g. 0.01 wt %) of well-dispersed GO in Ag is enough to dramatically reduce the friction coefficient compared with pure Ag in dry conditions (from ca 1.4-1.5 for pure Ag to ca 0.08-0.09 for the Ag-GO composite) and increase wear resistance without sacrificing the electrical properties of Ag.

The methodology may be applied to G and/or GO, as well as chemically functionalized G and/or GO. However, GO may be preferred due to cost.

Silver-graphene (Ag-G) or silver-graphene oxide (Ag-GO) nanocomposites are attractive candidates for sliding contact applications in tap changers, but also in e.g. circuit breaker, switches etc. The reduction of friction could enable easier and completely new and compact mechanical designs, increased contact pressures leading to reduced losses and more efficient use, and hence reduced cost, of materials.

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. A metal-graphene composite product in the form of a sliding contact of an electric power application, the composite product comprising:

a metal matrix that consists of one or more of Ag, Au, Pt, Cu, Al, In and Sn; and graphene flakes that are dispersed in the metal matrix, wherein the graphene is present in an amount within the range of from 0.005 to less than 0.02 wt %, wherein the graphene flakes comprise graphene and graphene oxide, and wherein the graphene flakes have an average longest axis within the range of 30 microns to 50 microns.

2. The composite product of claim 1, wherein the sliding contact is for an on-load tap changer.

3. The composite product of claim 2, wherein the metal is silver.

4. The composite product of claim 2, wherein the graphene is present in an amount of about 0.01 wt %.

5. The composite product of claim 1, wherein the metal matrix is silver.

6. The composite product of claim 1, wherein the composite product includes a compacted metal-graphene composite green body.

7. The composite product of claim 1, wherein the composite product includes a sintered metal-graphene composite product.

8. The composite product of claim 1, wherein the composite product has a friction coefficient of 0.08-0.09.

* * * * *